US005560875A

United States Patent [19]

Meshengisser et al.

[11] Patent Number: 5,560,875

[45] Date of Patent: Oct. 1, 1996

[54] AERATING DEVICE

[75] Inventors: Jury M. Meshengisser; Rostislav A. Galich, both of Kharkov, Ukraine

[73] Assignee: Tovarischestvo s ogranichennoi otvetstvennostju "EKOPOLIMER", Belgorod, Russian Federation

[21] Appl. No.: 489,807

[22] Filed: Jun. 13, 1995

[30] Foreign Application Priority Data

Mar. 12, 1995 [RU] Russian Federation ..... 95107035

[51] Int. Cl.[6] ..... B01F 3/04

[52] U.S. Cl. ..... 261/122.1

[58] Field of Search ..... 261/122.1

[56] References Cited

U.S. PATENT DOCUMENTS

| | | | |
|---|---|---|---|
| 2,063,480 | 12/1936 | Braem | 261/122.1 |
| 3,603,509 | 9/1991 | Nechine | 261/122.1 |
| 3,644,231 | 2/1972 | Maruya et al. | 261/122.1 |
| 4,118,447 | 10/1978 | Richter | 261/122.1 |
| 5,288,631 | 2/1994 | Baumgartner et al. | 261/122.1 |
| 5,352,610 | 10/1994 | Braeutigam | 261/122.1 |

FOREIGN PATENT DOCUMENTS

| | | | |
|---|---|---|---|
| 495843 | 9/1953 | Canada | 261/122.1 |
| 1803391 | 7/1990 | U.S.S.R. . | |

OTHER PUBLICATIONS

Booklet of Messrs. "Schumascher Brandol area" GmbH and Co. KG, Germany.

*Primary Examiner*—Tim R. Miles

*Attorney, Agent, or Firm*—Collard & Roe, P.C.

[57] ABSTRACT

The aerating device compraises a tubular air conduit whose external surface of the side wall is provided with longitudinal ribs alternating with longitudinal recesses and is covered with a two-layer dispersing coating. The first (internal) layer of the dispersing coating is made as a fibrilliform filament wound on the external surface of the air conduit with a surface density of 1.1–2.0 kg/sq m, the second (external) layer of the dispersing coating is a porous envelop made of material with chaotically laid fibers of a diameter from $6\times10^{-5}$ to $21\times10^{-5}$ m fused at the points of their intersection and applied to the internal layer with a density of $3.5\times10^{2}$ to $6.0\times10^{2}$ kg/cu m. The side wall of the air conduit at the point of each recess has a number of radial holes, each having a diameter (d) varying from 0.05 to 0.12 the inside diameter (D) of the tubular air conduit.

5 Claims, 3 Drawing Sheets

AERATING DEVICE

FIELD OF ART

The present invention relates to saturation of liquids with gas and, more particularly, to an aerating device.

The present invention will be most effectively utilized in the pneumatic aeration systems resorted to biological treatment of sewage.

Besides, the present invention can be used to advantage in floatation systems, in chlorination of water, supply of air for washing the granular filler of filters used in treatment of natural and industrial sewage water, discharge of filtered water after its purification, and in draining of land.

BACKGROUND OF THE INVENTION

Known in the prior art is an aerating device (Booklet of Messrs "Schumascher Brandol area" GMBH and Co. KG, Germany) comprising a tubular air conduit with radial holes spaced along one of its side wall generatrices. Secured rigidly above each hole on the side wall of the air conduit is a dispersing member in the form of a cylinder plugged at both ends. The side surface of the cylinder facing the air conduit has air holes arranged coaxially with the radial holes and intended for the passage of air from the air conduit into the dispersing member. Each dispersing member is made from Brandol ceramics which are a mixture of pure natural quartz sand with artificial resin. The graininess of this ceramic material is 80–120 and the diameter of its pores, approximately $19\times10^{-5}$ m.

The above-mentioned aerating device features a high aerating capability attributed to a high degree of dispersion of the air delivered into the aerated liquid. However, the design of said device denies the possibility of uniform distribution of air bubbles throughout the length of the air conduit owing to a discrete arrangement of the dispersing members on the side wall of the air conduit.

In addition, the provision of separate dispersing members and the sophisticated nature of their fastening to the air conduit as well as the use of costly materials for their manufacture increase the cost of the aerating device and the amount of labor involved in its installation.

A further known aerating device (SU, A1, 1803391) comprising a tubular air conduit whose external surface of its side wall is provided with longitudinal ribs alternating with longitudinal recesses. Each longitudinal recess in the side wall of the air conduit has radial holes. The external surface of the air conduit side wall is provided with a two-layer dispersing coating. The first (internal) layer of said coating is made of a fibrous material wound tightly on the external surface of the air conduit while the second (external) layer has the form of a continuous coating of a fibrous material.

The above-mentioned aerating device is of a simpler design than the preceding one.

However, there is no optimization of parameters of the aerating system in said device with respect to the delivery of air, loss of pressure, uniform distribution of air bubbles, service life of the device, etc. Therefore, in case of, for example, an insufficient density of layers of the dispersing coating, the degree of dispersion of the air delivered into the liquid being treated will be considerably reduced just as the uniformity of distribution of these bubbles in the zone of contact therewith, which means that the maximum amount of air delivered into the air conduit will enter said liquid at the initial portion of the air conduit, failing to reach its terminal portion.

An excess density of layers of the dispersing coating will increase considerably the expenditures of energy required for efficient aeration of liquid since the excess density increases considerably the resistance of the air conduit side wall to the passage of air into the aerated liquid and calls for a higher pressure in the air conduit to ensure the supply of the preset amount of air into the aerated liquid.

BRIEF DESCRIPTION OF THE INVENTION

The main object of the present invention resides in promoting the degree of dispersion of the air delivered into the aerated liquid.

Another no less important object of the present invention resides in increasing the uniformity of distribution of air bubbles in the zone of contact with the liquid being treated along the entire length of the aerator.

Still another object of the invention lies in cutting down the energy consumption for dispersing the air while ensuring efficient aeration of the liquid to be treated.

And, finally, a still further object of the invention lies in reducing the amount of labor involved in installation of the aerating device and reducing its cost.

These and other objects are attained by providing an aerating device comprising a tubular air conduit whose first and second ends are provided, respectively, with the first and second plugs of which the first one has a hole for the delivery of compressed air into said tubular air conduit whose external surface of the side wall has longitudinal ribs alternating with longitudinal recesses, said wall in the area of each last recess has radial holes, said external surface is covered with a dispersing coating which forms, together with said ribs and recesses, longitudinal channels and consists of the first (internal) and second (external) layers made of a fibrous material wherein, according to the invention, the internal layer of the dispersing coating has the form of a fibrilliform filament wound tightly, without clearances, around the external surface of the side wall with a surface density from 1.1 to 2.0 kg/sq m, the external layer of the dispersing coating is a porous envelope made from a material consisting of chaotically laid fibers with a diameter from $6\times10^{-5}$ to $21\times10^{-5}$ , fused together at the points of their intersection, and applied to the internal layer with a density from $3.5\times10^{2}$ to $6.0\times10^{2}$ kg/cu m and each of said radial holes has a diameter from 0.05 to 0.12 the inside diameter of said tubular air conduit.

It is practicable that each of said radial holes in each said row should be located at a distance from the adjacent radial hole of this row, the diameter of said hole amounting to 1.3–2.8 the inside diameter of said air conduit.

It is desirable that the cross-sectional area of each of said longitudinal channels should be equal to 0.2–0.9 the cross-sectional area of said radial hole.

It is good practice to locate each of said ribs at a distance from said adjacent rib, said distance being equal to 0.15–0.4 the inside diameter of said air conduit.

It is possible that each of said ribs and each of said recesses should be spiral-shaped.

In the aerating device according to the invention all the parameters of the aerating system such as uniform distribution of air throughout the length of the air conduit, delivery of air bubbles into the liquid being treated, uniform distribution of air bubbles in the zone of their contact with liquid, pressure losses, service life of the device, etc. have been optimized. This enhances the efficiency of liquid aeration by uniform distribution of air throughout the length of the air conduit owing to intensified dispersion of air passing through the first (internal) layer of the dispersing coating and to reduced coalescence of air bubbles as they pass through the second (external) layer of the dispersing coating.

This ensures uniform distribution of air bubbles in their zone of contact with liquid throughout the length of the aerator, achieved due to the optimum wall resistance of the tubular air conduit.

Apart from that, the carefully selected relationship of the above-mentioned parameters makes it possible, apart from the uniform distribution of air bubbles in the liquid being treated, to reduce the consumption of energy for intensive dispersing of air.

BRIEF DESCRIPTION OF THE DRAWINGS

For better understanding of the invention, given below is its concrete embodiment with reference to the appended drawings wherein.

DETAILED DESCRIPTION OF THE INVENTION

Figure 1:
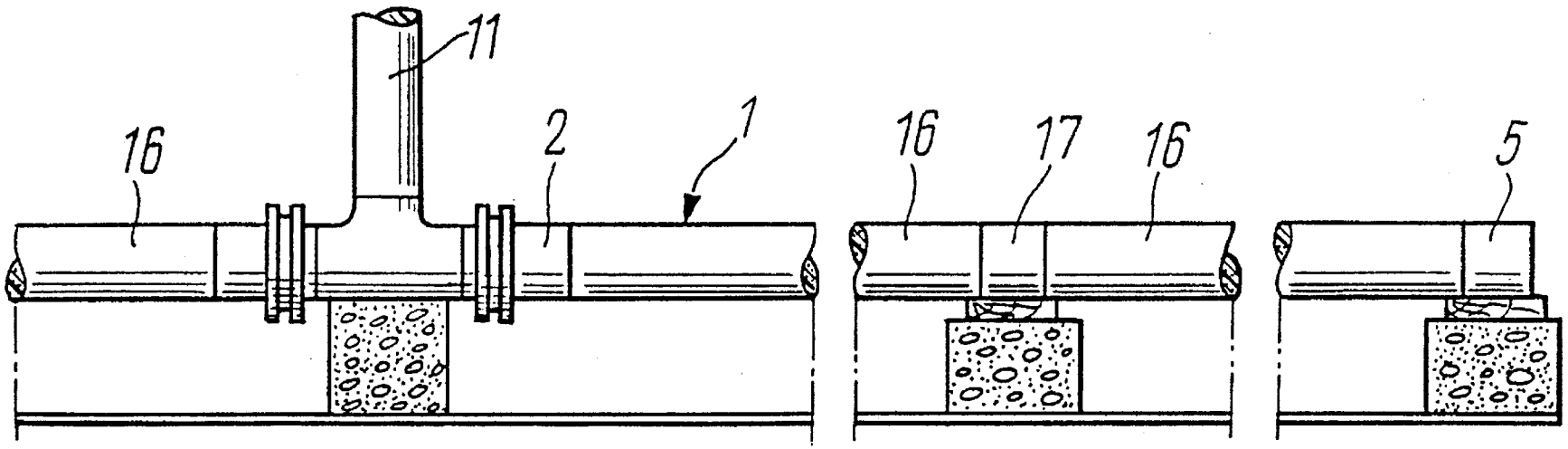
FIG. 1 is a schematic diagram of the aerating device according to the invention, a general view with a break.
Figure 2:
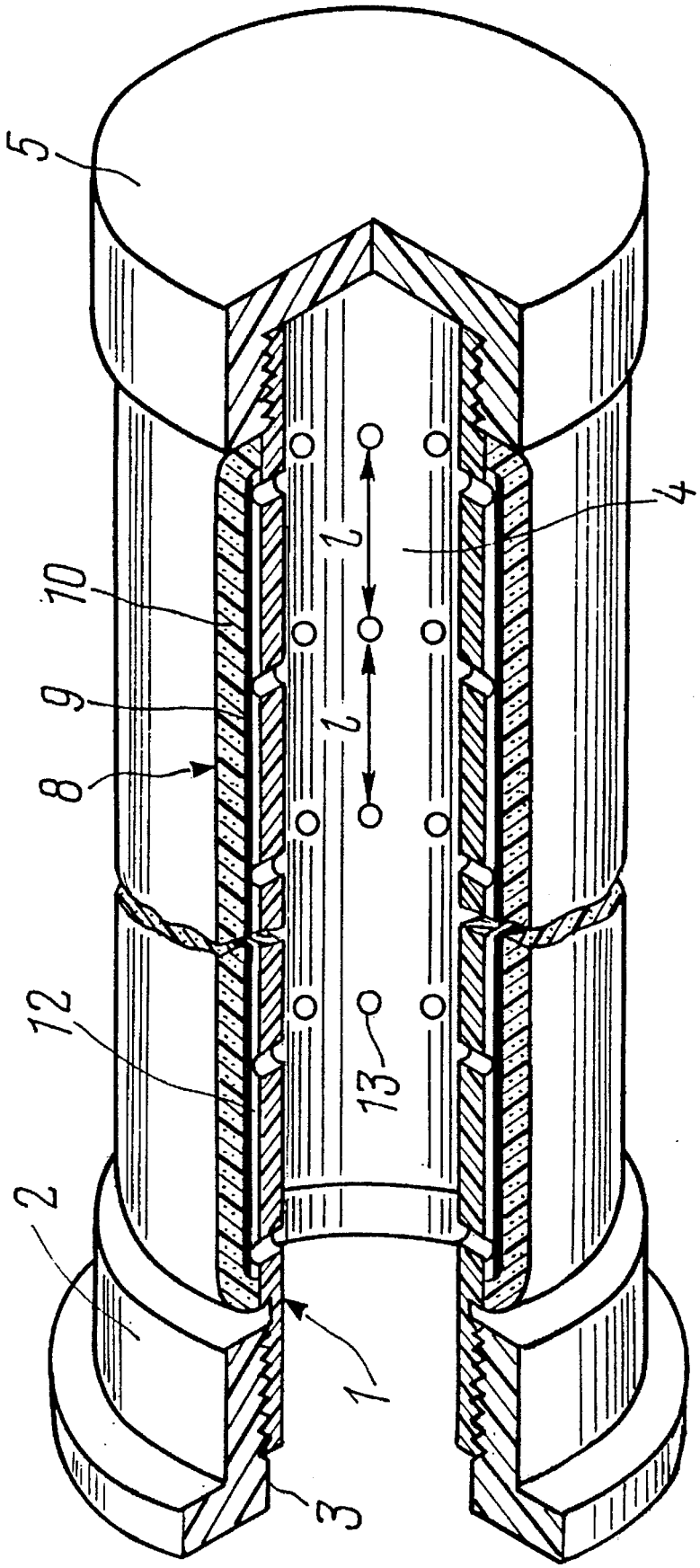
FIG. 2 is the aerating device according to the invention, axonometric view with a quarter cutout and a break.

The aerating device according to the invention comprises a tubular air conduit 1 (FIG. 1) one end of which has a first plug 2 with a hole 3 (FIG. 2) for the delivery of compressed air into the space 4 of the tubular air conduit 1 while its other end has a second plug 5 preventing the escape of compressed air from the space 4 of the air conduit 1. The best material of the air conduit 1 is high-density polyethylene with an inside diameter (D) of about 0.1 m.

Figure 3:
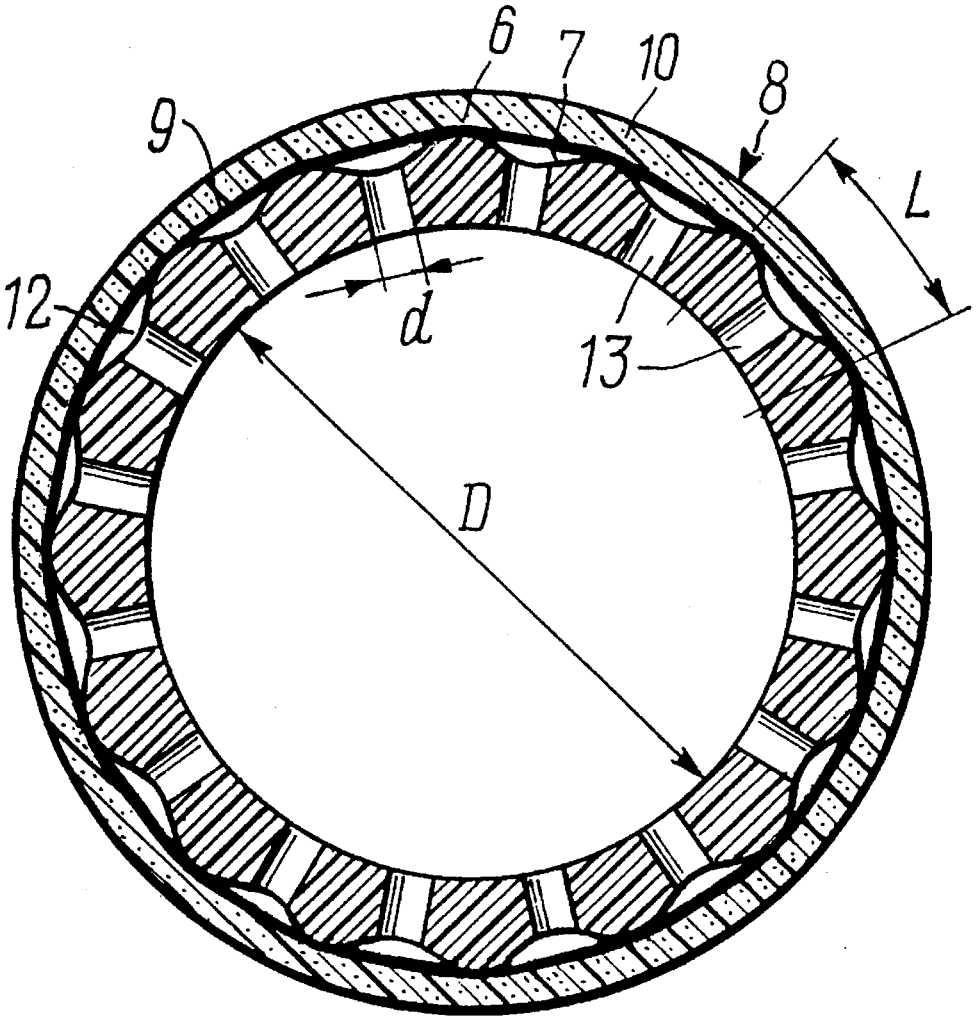
FIG. 3 is the aerating device according to the invention, cross section.

The external surface of the air conduit 1 around its side wall is provided with a plurality of ribs 6 (FIG. 3) alternating with a plurality of recesses 7 and is coated with a dispersing coating 8. The number of ribs 6 and corresponding recesses 7 depends on the particular service conditions of the aerating device, including pressure built up in the space 4 of the air conduit 1. The higher the compressed air pressure (i.e. the larger the depth of the aeration tank), the smaller number of ribs 6 and corresponding recesses 7 is required for effective aeration of the liquid being treated.

In this particular embodiment the external surface of the air conduit 1 has sixteen ribs 6 and sixteen recesses 7 which are $3.5\times10^{-3}$ m deep.

The dispersing coating 8 is of a double-layer type. The first (internal) layer 9 of the dispersing coating 8 is made from a fibrous material as a fibrilliform filament wound tightly, without clearances, around said external surface with a surface density of 1.1–2.0 kg/sq m.

Said surface density of the first layer 9 of the dispersing coating 8 ensures an optimum dispersing of air as it passes through this layer 9 and brings about a uniform distribution of air bubbles throughout the length of the air conduit 1, thus stepping up the aerating efficiency.

A reduction of surface density of the first layer 9 below 1.1 kg/sq m diminishes its resistance and increases the size of its pores and, hence, increases the size of the air bubbles passing through the first layer 9 of the dispersing coating 8 thus worsening the efficiency of aeration. Besides, this increases the nonuniformity of aeration along the length of the air conduit 1, because a larger amount of air escaping on its initial portion will fail to reach its end portion which will likewise affect adversely the aerating efficiency.

An increase of the surface density in the first layer 9 of the dispersing coating 8 above 2.0 kg/sq m will diminish considerably the size of its pores and, consequently, will increase its resistance to the passage of the air bubbles thus reducing the efficiency of aeration since it calls for a considerable increase of pressure to ensure the passage of air through the pores of the first layer 9 and increases energy consumption.

In the given concrete embodiment the fibrilliform filament of the first (internal) layer 9 is made from polypropylene and wound without clearances in two rows over the external surface of the side wall of the air conduit 1 with a surface density of 1.35 kg/sq m.

The second (external) layer 10 of the dispersing coating 8 has the form of a porous envelope from a material with chaotically laid fibers with a diameter of $6\times10^{-5}$ to $21\times10^{-5}$ m, fused together at the points of intersection. The second layer 10 is applied to the first 9 layer with a density from $3.5\times10^{3}$ to $6.0\times10^{3}$ kg/cu m.

In this particular embodiment the second (external) layer 10 of the dispersing coating 8 is made of low-density polyethylene applied to the surface of the first (internal) layer 9 by the method of pneumatic extrusion with a density of $4.3\times10^{3}$ kg/cu m.

Said type of the external layer 10 ensures higher efficiency of aeration since it rules out the sticking together of the air bubbles during their passage through the internal layer 9 and provides for a high degree of dispersion of air on its contact with the liquid being treated. Besides, the above-described characteristics of the layers 9 and 10 optimize the liquid-to-air contact area since this contact begins already in the depth of the external layer 10. The dispersing coating 8 develops an optimum resistance to the escape of air and uniform distribution of air bubbles throughout the length of the air conduit 1.

The reduced density of the external layer 10 below $3.5\times10^{3}$ m diminishes resistance to the passage of air through this layer 10 thus causing coalescence of the air bubbles coming from the first layer 9 of the dispersing coating which, in turn, reduces the degree of air dispersion and interferes with the uniformity of distribution of air bubbles throughout the length of the air conduit 1.

The increased density of the external layer 10 over $6\times10^{3}$ kg/cu m results in diminishing the size of its pores and raises the resistance of the dispersing coating 8 to the outflow of air bubbles into the liquid being treated which at the same energy expenditure reduces considerably the efficiency of aeration.

The chaotic distribution of fibers in the second layer 10 of the dispersing coating 8 at the preset parameters of said fibers ensures an optimum porosity of said second layer 10 of this coating 8 which preserves the degree of air dispersing reached during the passage of air through the first layer 9 owing to the elimination of coalescence of air bubbles. Fusion of fibers at their points of intersection provides for the requisite strength of the external layer 10 required during operation of the aerator and its intensive cleaning with air after pollution in order to restore its aerating capacity. Thus, fusion of the fibers increases the air dispersing degree and extends the service life of the aerator.

The above-stated limits of fiber diameters give an optimum relation of porosities in the first and second layers 9, 10 of the dispersing coating 8 and ensures an optimum degree of air dispersing. The resistance of the wall of the air conduit 1 to the passage of air produced at these relations results in a uniform distribution of air bubbles along the entire length of the aerator.

If the fiber diameter is increased above $21\times10^{-5}$ m, this will bring about a reduction of air dispersing and produce a substantial nonuniformity of the outflow of dispersed air into the liquid being treated throughout the length of the air conduit 1 which is associated with a reduced resistance of the side wall of the air conduit 1 to the outflow of air. Under these conditions the major part of the air will flow into the liquid being treated at the initial portion of the air conduit 1 without reaching its terminal portion. As a result, the aerator may quickly get out of commission since insufficient rate of air flow in the terminal portion of the air conduit 1 will cause seeping of liquid into said conduit, thus polluting the dispersing coating 8.

If the fiber diameter is reduced under $3\times10^{-5}$ m, this will increase substantially the resistance of the wall of the air conduit 1 to the passage of air which, in case of a reduced preset air demand for aeration, will call for a considerable growth of energy expenditure.

The dispersing coating 8 is made on the principle of the inverse filter since porosity and the average size of pores of the external layer 10 are larger than those of the internal layer 9.

For delivery of compressed air from an air blower (not shown in the drawing) into the space 4 of the air conduit 1, the aerating device incorporates a pipeline 11 communicating with the air conduit 1 through the hole 3 in the first plug 2. For uniform distribution of compressed air throughout the length of the air conduit 1, the internal surface of said internal layer 9 and the external surface of said ribs 6 and said recesses 7 forms a plurality of longitudinal channels 12 under the dispersing coating 8. To deliver air into the longitudinal channels 12 from the space 4 of the air conduit, the side wall of the conduit 1 is provided with a row of radial holes 13 in each of the recesses 7.

Each radial hole 13 has a diameter (d) varying from 0.05 to 0.12 the inside diameter (D) of the air conduit 1 and is located at a distance (L) from the adjacent radial hole 13 in each row, said distance being equal to 1.3–2.8 the inside diameter (D) of the air conduit 1.

The cross-sectional area of each longitudinal channel 12 is 0.2–0.9 the cross-sectional area of the radial hole 13.

The above-stated size of the radial holes 13 preassigned as the function of the inside diameter (D) of the air conduit 1 raises the aeration efficiency since in ensures uniform delivery of compressed air to the channels 12 throughout the length of the aerator from the first plug 2 to the second plug 5. Said distance (L) between the adjacent radial holes 13 in each row provides for uniform air pressure in each channel 12. All the above factors result in a uniform delivery of compressed air to the dispersing coating 8 throughout the length of the air conduit 1 and in a uniform distribution of air bubbles in the treated liquid.

If the diameter (d) of the radial holes 13 is increased to exceed 0.12 the inside diameter (D) of the air conduit 1, this will reduce the uniformity of compressed air distribution in the channel 12 along the length of the aerator. This will be accompanied by an increased air flow rate in the initial portion of the air conduit 1 while this flow rate in its terminal portion will drop and, in case of a considerable increase of the diameter (d) of the radial holes 13, the air may fail to reach the terminal portion at all. In this case the air conduit 1 in its terminal portion will be partly filled with the liquid being treated thus soiling quickly the channels 12 and the dispersing coating 8. Besides, an increase in the diameter (d) of the holes 13 will reduce the air dispersing degree because the increased air flow rate in the initial portion of the air conduit 1 raises sharply the coalescence of air bubbles passing through the layers 9, 10 of the dispersing coating 8.

If the diameter (d) of the radial holes 13 is reduced below 0.05 the inside diameter (D) of the air conduit 1, this will bring about a considerable increase of energy expenditures for aeration and, in addition, rapid fouling of the holes 13 with dust and dirt particles thereby curtailing the service life of the aerator.

If the distance (L) between the adjacent radial holes 13 is smaller than stated above (while preserving their diameter), this will reduce considerably the uniformity of air flow rate throughout the length of aerator and, in addition, the higher flow rate of air in the initial portion of the air conduit 1 will reduce the degree of air dispersion due to heavier coalescence of air bubbles, thus affecting adversely the aerating efficiency.

An increase of said distance (L) will reduce uniformity of air distribution between the adjacent radial holes 13. In this case the middle portion of the channel 12 between the adjacent holes 13 will be filled partly or completely with the handled liquid. This will result in quick soiling of the channel and, as a consequence, in reduction of the efficient service life of the aerator. To preserve the preset aeration efficiency it will be necessary to deliver a larger amount of air which in turn, will increase the energy demand for aeration.

In this particular embodiment of the invention the diameter (d) of each radial hole 13 is 0.008 m and the holes are spaced at a distance (L) of 0.21 m.

The above-defined interrelation of the cross sectional areas of the channel 12 and radial holes 13 produces uniform distribution of air in the portion between the two adjacent radial holes 13.

In the cross-sectional area of each channel 12 is reduced below the above-stated value, this will increase the resistance of the channel 12 to the passage of air and it will escape through the dispersing coating 8 in the form of a "torch" opposite each hole 13, spreading but little to the portions adjoining the hole 13. Apart from that, a reduction of the cross-sectional area of the channel 12 will result in its prompt fouling with dust and dirt and in curtailing the service life of the aerator.

An increase in the cross-sectional area of each channel 12 above the stated value is inexpedient due to a larger consumption of material for making higher ribs 6 and the associated increase of the aerator outside diameter which requires the use of a larger amount of the material of the dispersing coating 8. In addition, an increase in the cross-sectional area of each channel 12 will impair the aerator performance because this reduces the air pressure so that the handled liquid penetrates into the channel 12 in its middle portion between the holes 13. This reduces both the uniformity of aeration on the portion between the radial holes 13 and the degree of air dispersing.

It is evident that the dispersed air comes into contact with liquid, activating only a certain upper segment of the aerator whose size determines the air-to-liquid contact zone. The size of this zone depends on the amount of delivered air and fouling of the channels 12 and the pores of the dispersing coating 8 with particles of dust and dirt contained both in the liquid and delivered air. Therefore, for concurrent activation of a maximum number of channels 12 and, consequently, the maximum area of the dispersing coating 8, the ribs 6 are made on the circumference of the air conduit 1 at a distance (L) between the adjacent ribs 6, said distance being equal to 0.15–0.4 the inside diameter (D) of the air conduit 1.

An increase in the distance (L) between the ribs 6 in excess of the above-states limit will confine the segment of efficient aerator performance to a single channel 12 which reduces the air dispersing degree because the dense outflow of air bubbles (per unit area of the dispersing coating 8), will intensify their coalescence. Under these conditions, if aerating efficiency is to be preserved, the amount of delivered air will have to be increased, thus stepping up the energy expenditures for aeration.

If the distance (L) between the ribs 6 is smaller than prescribed, this will reduce the cross-sectional area of the channels 12 and cause their prompt fouling, thus reducing the aerator service life. The energy expenditures will also grow substantially.

In this particular example the ribs 6 are spaced at a distance (L) equal to 0.026 m.

Figure 4:
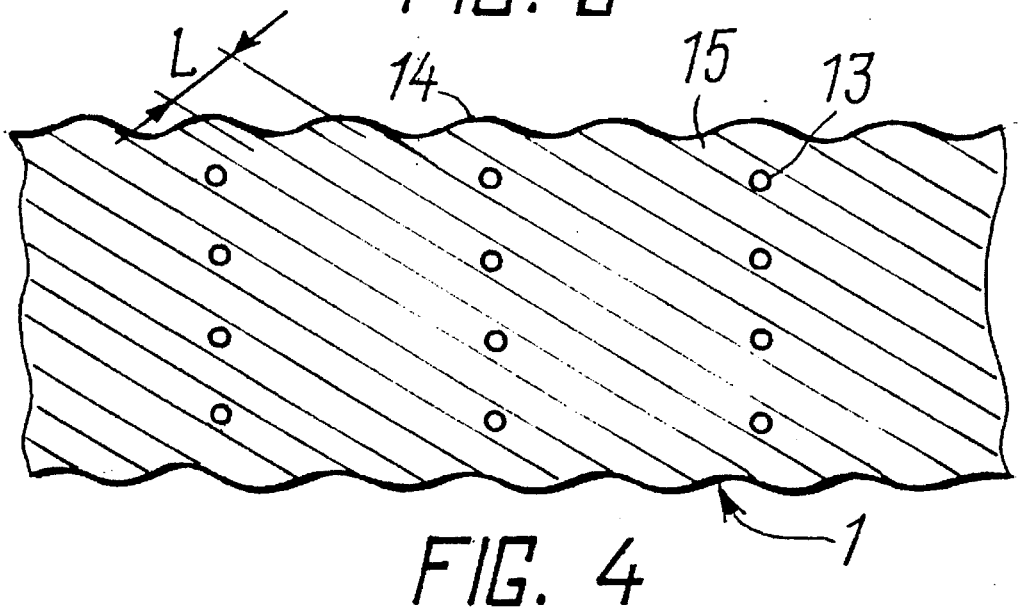
FIG. 4 is a fragment of the air conduit according to the invention, side view.

In case of a shallow depth of the treated liquid or when using a low-pressure air blower (not shown in the drawing), the ribs 14 (FIG. 4) and the corresponding recesses 15 may be arranged on a helical line. This enables increasing the zone of contact between the air bubbles and the treated liquid thus improving the uniformity of air outflow; reducing the coalescence of its bubbles and enhancing the aerating efficiency.

Depending on the size of the aeration tank (not shown in the drawing) accommodating the claimed aerating device, the air conduit 1 (FIG. 1) may be made from individual modules 16 held together by any conventional method, for example by threaded couplings 17.

Thus, the disperser of the aerating device according to the invention is structurally joined with the air conduit and all the parameters of the aerating system are optimized, such as delivery of air bubbles into the liquid being treated, uniform distribution of the air bubbles in the zone of the contact with the liquid, pressure losses and service life of the device, etc. This increases the degree of dispersing of the air delivered into the aerated liquid, raises the uniformity of air bubble distribution in the zone of contact with the treated liquid throughout the length of the aerator, cuts down energy losses for air dispersing, reduces the amount of labor required for installation of the aerating device and thus reduces its cost while ensuring efficient aeration of the handled liquid.

The design of the claimed aerating device is noted for a high sturdiness and resistance to aggressive media and hydraulic shocks.

The aerating device functions as follows.

Compressed air is delivered from the air blower via the pipeline 11 and the hole 3 into the space 4 of the tubular air conduit 1. This air flows through the radial holes 13 into the longitudinal channels 12 and is distributed uniformly in the recesses 7 disposed between the ribs 6. Under the effect of the built-up pressure, compressed air penetrates through the first layer 9 then through the second layer 10 of the dispersing coating 8 and enters in the form of bubbles into the aerated liquid, spreading therein uniformly throughout the length of the aerator.

We claim:

1. An aerating device comprising:

a tubular air conduit;

a side wall of said air conduit;

a first end of said air conduit;

a second end of said air conduit;

a compressed air space of said air conduit;

an external surface of said side wall of said air conduit;

a first plug installed on said first end of said air conduit and provided with a hole for delivery of compressed air into said space of said air conduit;

a second plug installed on said second end of said air conduit and preventing the escape of compressed air from said space of said air conduit;

a plurality of longitudinal ribs made on said external surface along said side wall;

a plurality of longitudinal recesses made on said external surface along said side wall between each pair of adjacent ribs out of said plurality of said longitudinal ribs;

a dispersing two-layer coating of said air conduit;

a first layer of said dispersing coating made of a fibrous material in the form of fibrilliform filament wound tightly, without clearances, on said external surface of said side wall with a surface density of 1.1 to 2.0 kg/sq m;

a plurality of longitudinal channels formed by the first layer of said dispersing coating, by said plurality of longitudinal ribs and by said plurality of longitudinal recesses;

a row of radial holes provided in said side wall in each one of said plurality of longitudinal recesses for the delivery of compressed air from said space of said air conduit into each out of said plurality of longitudinal channels;

each radial hole out of said row of radial holes whose diameter is from 0.05 to 0.12 the inside diameter of said tubular air conduit;

a second layer of said dispersing coating made in the form of a porous envelope from a material with chaotically laid fibers with a diameter of $6\times10^{-5}$–$21\times10^{-5}$ m fused at the points of their intersection, applied to said first layer with a density of $3.5\times10^{2}$–$6.0\times10^{2}$ kg/cu m.

2. The aerating device of claim 1 wherein each said radial hole of each said row is disposed at a distance from the adjacent radial hole of this row which is equal to 1.3–2.8 the inside diameter of said air conduit.

3. The aerating device of claim 2 wherein each said longitudinal channel from said plurality of longitudinal channels has a cross-sectional area equal to 0.2–0.9 the cross-sectional area of said radial hole.

4. The aerating device of claim 3 wherein each said rib is made at a distance from said adjacent rib which is equal to 0.15–0.4 the inside diameter of said air conduit.

5. The aerating device of claim 4 wherein each said rib and each said recess is made on a helical line.

* * * * *